US010280859B2

(12) United States Patent
Tsukagoshi

(10) Patent No.: US 10,280,859 B2
(45) Date of Patent: May 7, 2019

(54) CONTROL SYSTEM FOR INTERNAL COMBUSTION ENGINE

(71) Applicant: TOYOTA JIDOSHA KABUSHIKI KAISHA, Toyota-shi, Aichi-ken (JP)

(72) Inventor: Takahiro Tsukagoshi, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/138,375

(22) Filed: Apr. 26, 2016

(65) Prior Publication Data

US 2016/0319759 A1 Nov. 3, 2016

(30) Foreign Application Priority Data

Apr. 28, 2015 (JP) ..... 2015-091571

(51) Int. Cl.

| | |
|---|---|
| ***F02D 41/06*** | (2006.01) |
| ***F01P 7/16*** | (2006.01) |
| ***F02D 41/30*** | (2006.01) |
| ***F02D 41/04*** | (2006.01) |
| *F01P 7/14* | (2006.01) |
| *F01P 3/02* | (2006.01) |

(52) U.S. Cl.

CPC ..... *F02D 41/068* (2013.01); *F01P 7/16* (2013.01); *F01P 7/162* (2013.01); *F02D 41/047* (2013.01); *F02D 41/064* (2013.01); *F02D 41/3094* (2013.01); *F01P 2003/027* (2013.01); *F01P 2007/143* (2013.01); *F01P 2037/02* (2013.01); *F02D 2200/021* (2013.01)

(58) Field of Classification Search

CPC ..... F02D 19/0692; F02D 2200/021; F02D 41/047; F02D 41/064; F02D 41/068; F02D 41/3094; F02M 69/046; F01P 2007/143; F01P 2007/146; F01P 7/16; F01P 7/161; F01P 7/162; F01P 7/164

USPC ..... 123/431

See application file for complete search history.

(56) References Cited

U.S. PATENT DOCUMENTS 7,269,941 B2 * 9/2007 Ichise ..... F02D 41/0235 123/295
7,694,507 B2 * 4/2010 Tokuda ..... F02D 41/3029 123/295

(Continued)

FOREIGN PATENT DOCUMENTS

EP 2333268 A2 6/2011
JP 2006-207453 A 8/2006

(Continued)

*Primary Examiner* — Mahmoud Gimie
*Assistant Examiner* — John Zaleskas
(74) *Attorney, Agent, or Firm* — Hunton Andrews Kurth LLP

(57) ABSTRACT

A control system reduces the amount of fuel injected from a second fuel injector in one cycle to an amount smaller than a second basic injection amount according to operating conditions of an internal combustion engine, and increases the amount of fuel injected from a first fuel injector in one cycle to an amount larger than a first basic injection amount according to operating conditions of the engine, during a predetermined period after a flow restricting operation is finished, so as to reduce fluctuations in the air-fuel ratio due to fluctuations in the wall temperature.

7 Claims, 7 Drawing Sheets

(56) References Cited

U.S. PATENT DOCUMENTS

2005/0061263 A1* 3/2005 Lee ..... F01P 7/167 123/41.1
2005/0178356 A1* 8/2005 Shibagaki ..... F02D 41/08 123/339.14
2006/0096572 A1* 5/2006 Satou ..... F02D 41/024 123/295
2006/0096575 A1* 5/2006 Araki ..... F02D 37/02 123/406.47
2006/0096577 A1* 5/2006 Araki ..... F02D 41/30 123/431
2006/0207554 A1* 9/2006 Nakamura ..... F02D 37/02 123/406.47
2006/0207562 A1* 9/2006 Miyazaki ..... F02D 35/027 123/431
2006/0225703 A1* 10/2006 Saito ..... F02D 41/047 123/431
2007/0000478 A1* 1/2007 Sadakane ..... F02D 41/38 123/431
2007/0095322 A1 5/2007 Mizutani
2009/0088957 A1* 4/2009 Yamada ..... F02P 5/1521 701/111
2009/0271091 A1* 10/2009 Morita ..... F02D 41/064 701/103
2009/0281709 A1* 11/2009 Mallebrein ..... F02D 35/025 701/104
2011/0098883 A1* 4/2011 Eser ..... F01P 5/14 701/33.4
2011/0120394 A1* 5/2011 Onozawa ..... F01P 7/162 123/41.1
2013/0032101 A1* 2/2013 Takeuchi ..... F01P 7/164 123/41.02
2014/0093393 A1* 4/2014 Araki ..... F01P 5/12 417/12
2014/0318501 A1* 10/2014 Mitani ..... F02D 19/061 123/478
2016/0363033 A1* 12/2016 Kitayama ..... F02D 41/3094

FOREIGN PATENT DOCUMENTS

JP 2007-218115 A 8/2007
JP 2008-095532 A 4/2008
JP 2011-111910 A 6/2011
JP 2012082756 A * 4/2012
JP 2013-204527 A 10/2013
JP 2013204527 A * 10/2013
WO 2008/012638 A1 1/2008

* cited by examiner

CONTROL SYSTEM FOR INTERNAL COMBUSTION ENGINE

INCORPORATION BY REFERENCE

The disclosure of Japanese Patent Application No. 2015-091571 filed on Apr. 28, 2015 including the specification, drawings and abstract is incorporated herein by reference in its entirety.

BACKGROUND OF THE INVENTION

1. Field of the Invention

The invention relates to a control system for an internal combustion engine including a first fuel injector that injects fuel into a cylinder of the engine, and a second fuel injector that injects fuel into an intake passage.

2. Description of Related Art

As one type of internal combustion engine installed on a vehicle, or the like, an internal combustion engine including a first fuel injector for injecting fuel into each cylinder, and a second fuel injector for injecting fuel into each intake port, is known. In the internal combustion engine of this type, it has been proposed to control the ratio between the amount of fuel injected from the first fuel injector in one cycle and the amount of fuel injected from the second fuel injector in one cycle, according to the engine load, engine rotational speed, coolant temperature, and so forth (see, for example, Japanese Patent Application Publication No. 2006-207453 (JP 2006-207453 A)).

SUMMARY

In recent years, it has also been proposed to perform an operation (which will be called "flow restricting operation") to restrict the flow rate of the coolant circulating in the engine to a predetermined flow rate or smaller, or stop circulation of the coolant in the engine, when the engine is in a cold state, in order to promote warm-up of the engine. In this technology, when the flow restricting operation is finished, the coolant is circulated in a condition where the temperature distribution of the coolant is formed, whereby the temperature of the coolant that circulates in the engine may rapidly fluctuate, or the amount of heat dissipated from the engine to the coolant may rapidly fluctuate. As a result, the temperatures (which will be collectively called "wall temperature") of a wall that defines the intake passage (which will be called "passage wall"), intake valve, etc., may also rapidly fluctuate. Here, a part of the fuel injected from the second fuel injector is deposited on the passage wall and the intake valve, and the fuel deposited on the passage wall and the intake valve evaporates when receiving heat from the passage wall and the intake valve. However, since the amount of the fuel thus evaporated depends on the wall temperature, the amount of evaporation of the fuel deposited on the passage wall and the intake valve also fluctuates, under the situation where the wall temperature rapidly fluctuates. As a result, the amount (which will be called "wall-deposited fuel amount") of the fuel that is kept deposited on the passage wall and the intake valve without evaporating may also fluctuate. If the wall-deposited fuel amount fluctuates, the amount of fuel introduced from the intake passage into the cylinder fluctuates, resulting in fluctuations in the air-fuel ratio of the mixture. Consequently, exhaust emissions may deteriorate, or torque fluctuations of the engine may appear.

Embodiments of the present invention provide a control system for an internal combustion engine including a first fuel injector that injects fuel into a cylinder, a second fuel injector that injects the fuel into an intake passage, and a flow restricting device that performs a flow restricting operation to restrict the flow rate of a coolant that circulates in the engine to a predetermined flow rate or smaller, or to stop circulation of the coolant in the engine, when the engine is in a cold state. The control system reduces fluctuations in the air-fuel ratio resulting from ending of the flow restricting operation.

The internal combustion engine includes the first fuel injector that injects fuel into the cylinder, the second fuel injector that injects the fuel into the intake passage, and the flow restricting device that performs a flow restricting operation to restrict the flow rate of the coolant that circulates in the engine to a predetermined flow rate or smaller, or to stop circulation of the coolant in the engine. In this internal combustion engine, when the engine is in a cold state, the amount of the fuel injected from the second fuel injector is reduced to be smaller than an amount according to operating conditions of the engine, during a predetermined period after the flow restricting operation is finished, so that fluctuations in the air-fuel ratio due to fluctuations in the wall temperature are reduced.

More specifically, the control system for the internal combustion engine according to one aspect of the invention is applied to the internal combustion engine including the first fuel injector that injects the fuel into the cylinder, the second fuel injector that injects the fuel into the intake passage, and a flow control device that performs a flow restricting operation to restrict the flow rate of the coolant that circulates in the engine to a predetermined flow rate or smaller, or to stop circulation of the coolant in the engine, when the engine is in a cold state. The control system includes control means for performing normal injection control, and injection control under fluctuating water temperature. Under the normal injection control, the first fuel injector and the second fuel injector are controlled, so that the amount of the fuel injected from the first fuel injector in one cycle is equal to a first basic injection amount according to operating conditions of the engine, and the amount of the fuel injected from the second fuel injector in one cycle is equal to a second basic injection amount according to the operating conditions of the engine. Under the injection control under fluctuating water temperature, the first fuel injector and the second fuel injector are controlled, so that the amount of the fuel injected from the first fuel injector in one cycle is larger than the first basic injection amount according to the operating conditions of the engine, and the amount of the fuel injected from the second fuel injector in one cycle is smaller than the second basic injection amount according to the operating conditions of the engine. The above-indicated one aspect of the invention may also be defined as follows. A control system for an internal combustion engine including a first fuel injector that injects a fuel into a cylinder of the internal combustion engine, a second fuel injector that injects the fuel into an intake passage of the internal combustion engine, and a flow control device configured to perform a flow restricting operation, is provided. The flow restricting operation is performed when the internal combustion engine is in a cold state, by (i) restricting a flow rate of a coolant that circulates in the internal combustion engine to a predetermined flow rate or smaller, or (ii) stopping circulation of the coolant in the internal combustion engine. The control system includes an electronic control unit configured to (a) perform normal injection control, under which the first fuel injector and the second fuel injector are controlled, such that an amount of the fuel injected from the first fuel injector in one cycle is equal to a first basic injection amount according to operating conditions of the internal combustion engine, and an amount of the fuel injected from the second fuel injector in one cycle is equal to a second basic injection amount according to the operating conditions of the internal combustion engine, and (b) perform injection control under fluctuating water temperature, under which the first fuel injector and the second fuel injector are controlled, such that the amount of the fuel injected from the first fuel injector in one cycle is larger than the first basic injection amount, and the amount of the fuel injected from the second fuel injector in one cycle is smaller than the second basic injection amount, during a predetermined period after the flow restricting operation is finished.

According to the control system for the internal combustion engine configured as described above, during the predetermined period after the flow restricting operation is finished, the amount of the fuel injected from the first fuel injector in one cycle is set to be larger than the first basic injection amount according to the operating conditions of the engine, and the amount of the fuel injected from the second fuel injector in one cycle is set to be smaller than the second basic injection amount according to the operating conditions of the engine. Therefore, even if the wall temperature fluctuates due to ending of the flow restricting operation, during the predetermined period after the flow restricting operation is finished, the amount of fuel deposited on the wall is less likely or unlikely to fluctuate, and therefore, the amount of fuel flowing from the intake passage into the cylinder is also less likely or unlikely to fluctuate. Consequently, fluctuations in the air-fuel ratio due to ending of the flow restricting operation can be reduced.

In order to reduce the amount of fluctuations in the amount of fuel deposited on the wall, it may be considered to determine the first basic injection amount and the second basic injection amount in view of the temperature of the coolant. However, under a situation where the temperature of the coolant rapidly fluctuates as in the predetermined period, a difference or deviation is likely to be produced between the coolant temperature and the wall temperature. Therefore, even if the first basic injection amount and the second basic injection amount are determined in view of the coolant temperature, the second basic injection amount may not be commensurate with the wall temperature. As a result, fluctuations in the amount of fuel deposited on the wall due to fluctuations in the wall temperature may not be effectively suppressed or reduced, and the air-fuel ratio of the mixture may fluctuate. On the other hand, the control system for the internal combustion engine according to an embodiment of the invention reduces the amount of fuel injected from the second fuel injector in one cycle to an amount smaller than the second basic injection amount according to the operating conditions of the engine, during the predetermined period; therefore, fluctuations in the amount of fuel deposited on the wall, and fluctuations in the air-fuel ratio, can be reduced with higher reliability.

The above-indicated control means may control the first fuel injector and the second fuel injector, so that the amount of fuel injected from the second fuel injector in one cycle becomes equal to or smaller than a predetermined fuel amount, during the predetermined period after the fuel restricting operation is finished. The "predetermined fuel amount" is determined so that the air-fuel ratio of the mixture can be held within a desired range (e.g., a range (which will be called "clean-up window") in which exhaust gas can be favorably cleaned up by an exhaust-gas treatment device), or torque fluctuations of the engine can be held within a range (which will be called "fluctuation permissible range") in which the driver does not feel strange or uncomfortable about the torque fluctuations, even if the fuel whose amount is equal to or smaller than the predetermined fuel amount is injected from the second fuel injector, when the wall temperature fluctuates due to ending of the flow restricting operation. The "predetermined fuel amount" is obtained in advance through adaptation work utilizing experiments, or the like. The predetermined fuel amount may also be zero.

With the above arrangement, when the wall temperature fluctuates due to ending of the flow restricting operation, the air-fuel ratio of the mixture is less likely or unlikely to deviate from the clean-up window, or the torque fluctuations of the engine are less likely or unlikely to deviate from the fluctuation permissible range. Consequently, deterioration of exhaust emissions, or deterioration of the driveability, can be curbed.

During the predetermined period after the flow restricting operation is finished, the second basic injection amount determined according to the operating conditions of the engine may become equal to or smaller than the predetermined fuel amount, depending on the operating conditions. In this case, the control means may control the first fuel injector and the second fuel injector, so that the amount of fuel injected from the first fuel injector in one cycle becomes equal to the first basic injection amount corresponding to the operating conditions of the engine, and the amount of fuel injected from the second fuel injector in one cycle becomes equal to the second basic injection amount corresponding to the operating conditions of the engine.

With the above arrangement, when the second basic injection amount is equal to or smaller than the predetermined fuel amount, during the predetermined period after the flow restricting operation is finished, it is possible to curb deviation of the air-fuel ratio of the mixture from a desired range, while controlling the amount of fuel injected from each of the first fuel injector and the second fuel injector in one cycle, to the fuel amount suitable for the operating conditions of the engine.

The predetermined period is a period in which the wall temperature may fluctuate due to ending of the flow restricting operation. For example, when the flow restricting operation is an operation to stop circulation of the coolant, the coolant located in the engine during execution of the flow restricting operation has a high temperature, whereas the coolant located outside the engine has a low temperature; therefore, a temperature distribution of the coolant is formed. If the flow restricting operation is finished in a condition where the temperature distribution of the coolant is formed, the high-temperature coolant in the engine initially flows out of the engine, and the low-temperature coolant outside the engine flows into the engine. Then, the high-temperature coolant that has flown out of the engine flows back into the engine, and the low-temperature coolant in the engine flows out of the engine again. As these phenomena are repeated, the wall temperature alternately rises and falls in a repetitive manner. Then, if the high-temperature coolant and the low-temperature coolant are mixed with each other, and the temperature of the entire volume of the coolant is homogenized, the wall temperature ceases to fluctuate. Accordingly, the predetermined period may be defined as a period from the time of ending of the flow restricting operation to the time when the temperature of the entire volume of the coolant is homogenized. Since this period is correlated with the amount of work of a water pump, a period from the time of ending of the flow restricting operation to the time when the amount of work of the water pump reaches a predetermined amount of work may be set as the predetermined period. In the case where the flow restricting operation is an operation to restrict the flow rate of the coolant circulating in the engine to a predetermined amount (e.g., an amount small enough not to prevent warm-up of the engine) or smaller, too, a temperature distribution of the coolant as described above is formed; therefore, a period it takes until the temperature distribution is eliminated (the temperature of the entire volume of the coolant is homogenized) may be defined as the predetermined period. Since there may be a more or less time lag between the time when the flow restricting operation is finished to the time when the wall temperature starts fluctuating, the predetermined period may be a period from the time when the above-described time lag after ending of the flow restricting operation is eliminated, to the time when the wall temperature ceases to fluctuate.

According to the above-indicated one aspect of an embodiment of the invention, in the internal combustion engine including the first fuel injector that injects fuel into the cylinder, the second fuel injector that injects the fuel into the intake passage, and the flow restricting device that performs a flow restricting operation to restrict the flow rate of the coolant circulating in the engine to a predetermined flow rate or smaller, or stop circulation of the coolant in the engine, when the engine is in a cold state, it is possible to reduce fluctuations in the air-fuel ratio due to ending of the flow restricting operation.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

One embodiment of the invention will be described with reference to the drawings. The dimensions, materials, shapes, relative arrangement, etc. of constituent components included in this embodiment are not intended to limit the technical scope of the invention to these details, unless otherwise stated.

Figure 1:
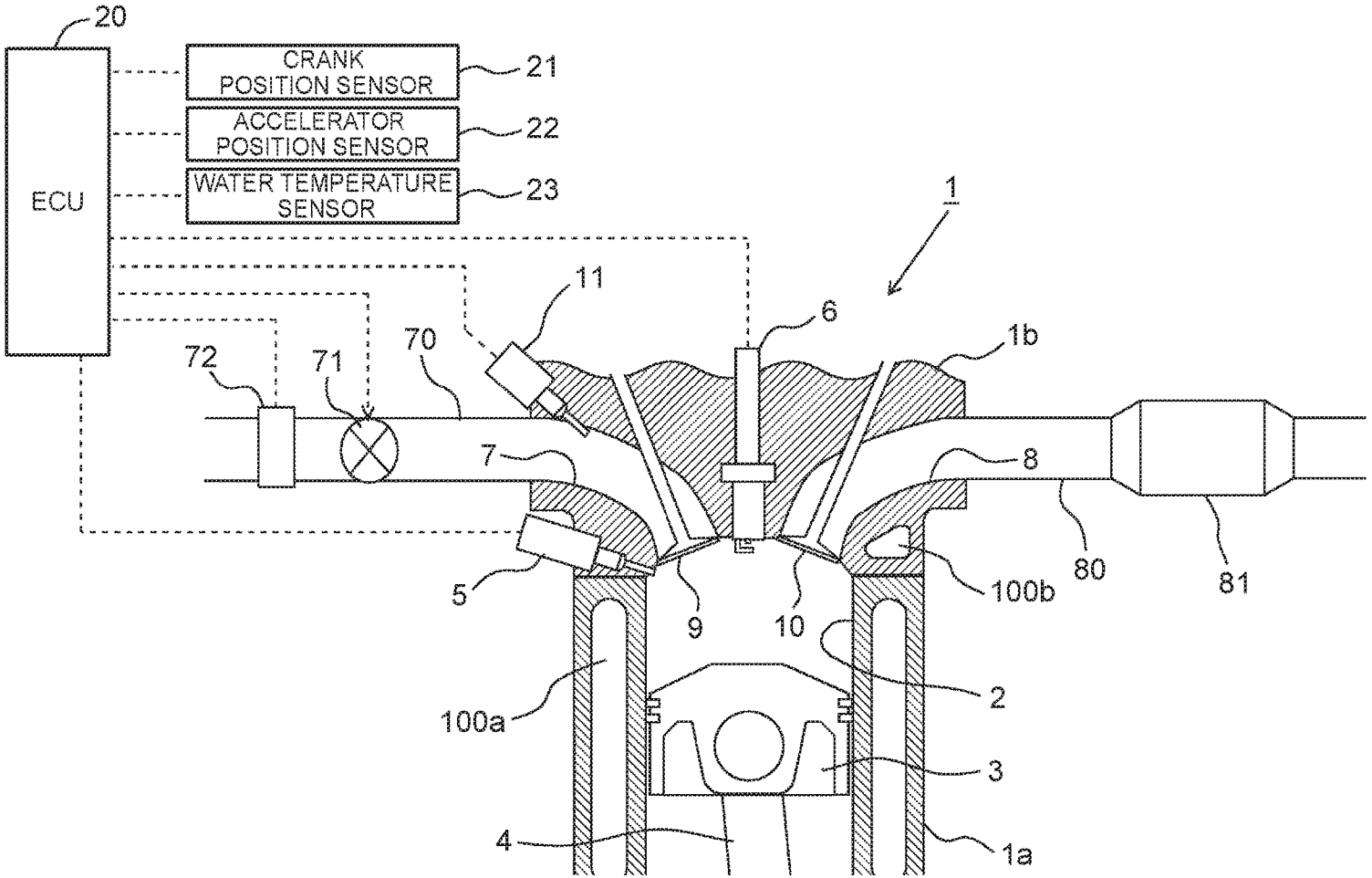
FIG. 1 is a view showing the general configuration of an internal combustion engine to which embodiments of the invention are applied.
Figure 2:
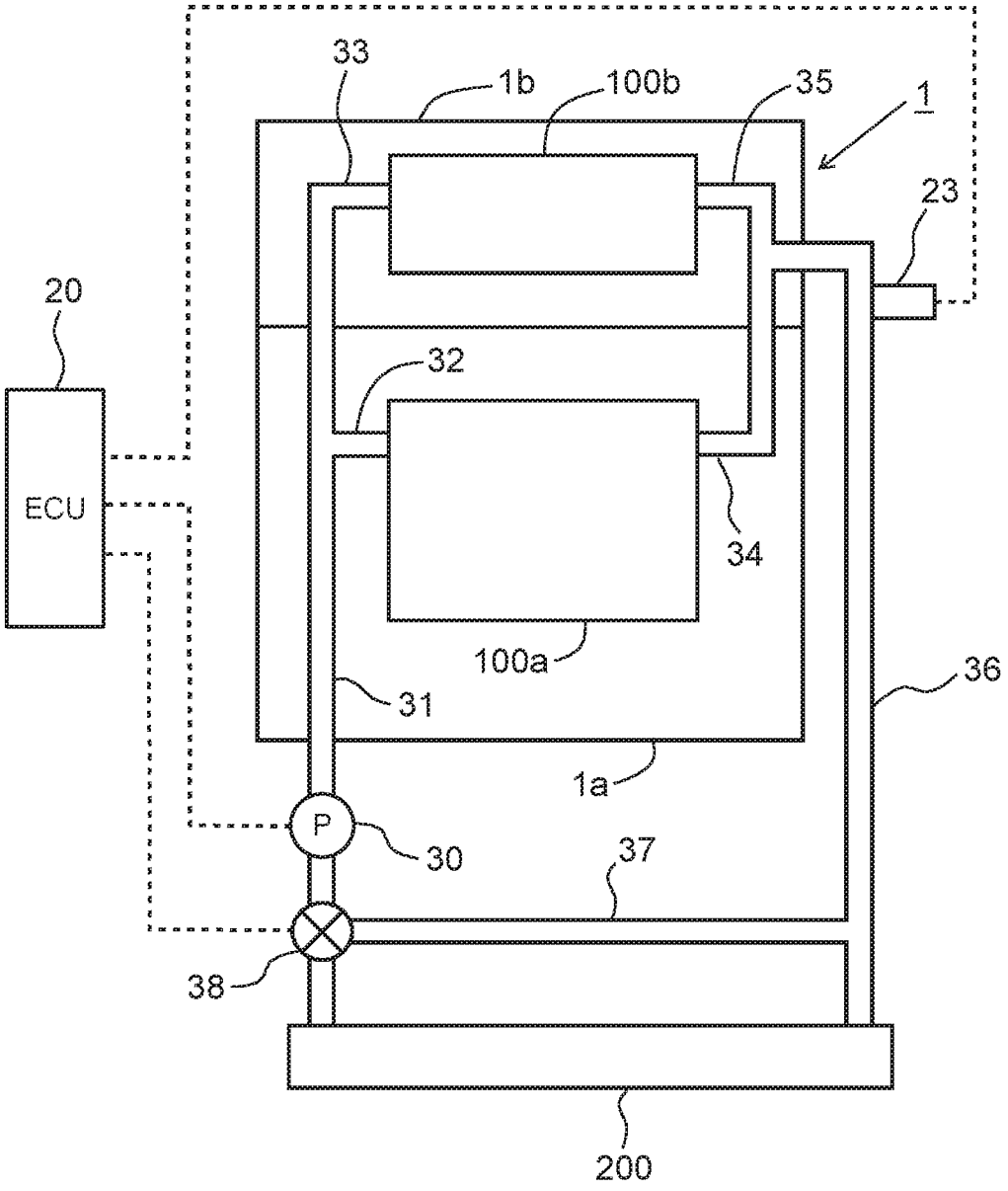
FIG. 2 is a view showing the general configuration of a cooling system of the internal combustion engine to which embodiments of the invention are applied.

FIG. 1 shows the general configuration of an internal combustion engine to which embodiments of this invention are applied. FIG. 2 shows the general configuration of a cooling system of the engine to which embodiments of this invention are applied. The internal combustion engine 1 shown in FIG. 1 and FIG. 2 is a four-stroke-cycle spark-ignition engine (gasoline engine) having a plurality of cylinders. In FIG. 1, only one cylinder, out of the plurality of cylinders, is illustrated.

A cylinder 2 is formed in a cylinder block 1*a* of the engine 1. A piston 3 is slidably received in the cylinder 2. The piston 3 is connected to an output shaft (crankshaft) (not shown) via a connecting rod. A first fuel injector 5 for injection fuel into the cylinder 2, and an ignition plug 6 for igniting an air-fuel mixture in the cylinder 2, are mounted in a cylinder head 1*b* of the engine 1.

An intake port 7 through which new air (air) is introduced into the cylinder 2, and an exhaust port 8 through which burned gas (exhaust gas) is discharged from the cylinder 2, are formed in the cylinder head 1*b*. The cylinder head 1*b* is also provided with an intake valve 9 for opening and closing an opening end of the intake port 7, and an exhaust valve 10 for opening and closing an opening end of the exhaust port 8. The intake valve 9 and the exhaust valve 10 are driven (i.e., opened and closed) by an intake cam and an exhaust cam (not shown), respectively.

The intake port 7 communicates with a passage (intake passage) in an intake pipe 70. A throttle valve 71 for changing the cross-sectional area of the passage in the intake pipe 70 is disposed in the intake pipe 70. An air flow meter 72 that measures the amount (intake air amount) of new air (air) flowing in the intake pipe 70 is disposed in the intake pipe 70 upstream of the throttle valve 71. A second fuel injector 11 for injecting fuel toward the intake port 7 is disposed in the intake pipe 70 downstream of the throttle valve 71.

The exhaust port 8 communicates with a passage (exhaust passage) in an exhaust pipe 80. An exhaust-gas treatment device 81 for converting hydrocarbon (HC), carbon monoxide (CO), and nitrogen oxides (NOx) in the exhaust gas is disposed in the exhaust pipe 80. The exhaust-gas treatment device 81 has a three-way catalyst, a NOx storage-reduction (NSR) catalyst, or the like, housed in a cylinder casing.

As shown in FIG. 2, a cooling system of the engine 1 includes a block-side coolant channel 100*a* formed in the cylinder block 1*a*, and a head-side coolant channel 100*b* formed in the cylinder head 1*b*. The block-side coolant channel 100*a* is located so as to surround the cylinder 2. The head-side coolant channel 100*b* is located close to the intake port 7 and exhaust port 8.

The cooling system also includes a water pump 30 that is driven by an electric motor. A discharge port of the water pump 30 is connected to a delivery channel 31. The delivery channel 31 branches into a first delivery channel 32 and a second delivery channel 33. The first delivery channel 32 is connected to an inlet of the block-side coolant channel 100*a*, and the second delivery channel 33 is connected to an inlet of the head-side coolant channel 100*b*. An outlet of the block-side coolant channel 100*a* is connected to a first return channel 34. An outlet of the head-side coolant channel 100*b* is connected to a second return channel 35. The first return channel 34 and the second return channel 35 join together, to form a single return channel 36. The return channel 36 is connected to a suction port of the water pump 30. A radiator 200 for conducting heat exchange between air and coolant is disposed in the return channel 36. Further, a bypass channel 37 that bypasses the radiator 200 is provided in the return channel 36. A thermostat 38 is provided in a connecting portion where an outlet of the bypass channel 37 is connected with the return channel 36. The thermostat 38 is a valve mechanism that switches between a position for conducting the return channel 36 located between an outlet of the radiator 200 and the suction port of the water pump 30, and a position for shutting off the return channel 36. More specifically, when the temperature of the coolant is equal to or lower than a given threshold value (e.g., 90° C.) for high-temperature determination, the thermostat 38 shuts off the return channel 36 located between the outlet of the radiator 200 and the suction port of the water pump 30, so as to establish flow of the coolant that bypasses the radiator 200. When the temperature of the coolant is higher than the threshold value for high-temperature determination, the thermostat 38 permits the coolant to pass through the return channel 36 between the outlet of the radiator 200 and the suction port of the water pump 30, so as to establish flow of the coolant via the radiator 200. When the temperature of the coolant is higher than the threshold value for high-temperature determination, the thermostat 38 may be arranged to shut off the bypass channel 37. The thermostat 38 may be a mechanical thermostat that automatically opens and closes according to the temperature of the coolant, or may be an electric thermostat that is opened and closed under control of an ECU 20.

The internal combustion engine 1 constructed as shown in FIG. 1 and FIG. 2 is equipped with the ECU 20. The ECU 20 is an electronic control unit that consists of CPU, ROM, RAM, backup RAM, and so forth. The ECU 20 receives output signals of various sensors, such as a crank position sensor 21, an accelerator position sensor 22, and a water temperature sensor 23, as well as the above-described air flow meter 72. The crank position sensor 21 outputs a signal correlated with the rotational position of the crankshaft. The accelerator position sensor 22 outputs an electric signal correlated with the operation amount (pedal stroke) of an accelerator pedal (not shown). The water temperature sensor 23 is provided in the return channel 36 (see FIG. 2), and outputs an electric signal correlated with the temperature of the coolant flowing through the return channel 36.

The ECU 20 is also electrically connected to various devices, such as the first fuel injector 5, ignition plug 6, second fuel injector 11, and the throttle valve 71, and controls these devices based on the output signals of the above-described various sensors. For example, the ECU 20 calculates the amount (first basic injection amount) of fuel injected from the first fuel injector 5 in one cycle, and the amount (second basic injection amount) of fuel injected from the second fuel injector 11 in one cycle, using the rotational speed calculated based on the output signal of the crank position sensor 21, the load calculated based on the output signal of the accelerator position sensor 22, the intake air amount measured by the air flow meter 72, etc., as parameters. Then, the ECU 20 controls the first fuel injector 5 and the second fuel injector 11, according to the first basic injection amount and the second basic injection amount, respectively. This control corresponds to "normal injection control" of the invention.

For a period (in which the engine 1 is considered to be in a cold state) from the time when the engine 1 is cold-started (the coolant temperature measured upon starting is equal to or lower than a threshold value (e.g., 40° C.) for determining cold start) to the time when the coolant temperature rises to be equal to or higher than a threshold value (e.g., 70° C.) for determining warm-up, the ECU 20 performs an operation (flow restricting operation) to stop the water pump 30, and stop circulation of the coolant in the block-side coolant channel 100*a* and the head-side coolant channel 100*b*. In this case, the amount of heat dissipated from the engine 1 via the coolant is reduced, and therefore, warm-up of the engine 1 can be promoted. Then, if the coolant temperature becomes higher than the threshold value for determining warm-up, the ECU 20 finishes the flow restricting operation by operating the water pump 30. Thus, the ECU 20 controls the water pump 30 in the above manner, so as to realize "flow control device" according to the invention.

In the meantime, during execution of the flow restricting operation, the coolant that remains in channels (such as the block-side coolant channel 100*a* and the head-side coolant channel 100*b*) inside the engine 1 is subjected to heat of the engine 1, and its temperature rises, whereas the coolant that remains in channels (such as the return channel 36 and the bypass channel 37) outside the engine 1 is kept at low temperatures. Therefore, when the flow restricting operation is finished, the coolant having a low temperature flows from the channels outside the engine 1 into the channels inside the engine 1, and at the same time, the coolant having a high temperature flows from the channels inside the engine 1 into the channels outside the engine 1. Then, the high-temperature coolant that has flown from the channels inside the engine 1 into the channels outside the engine 1 flows back into the channels within the engine 1, and the low-temperature coolant that has flown from the channels outside the engine 1 into the channels inside the engine 1 flows back into the channels outside the engine 1. These phenomena are repeated until the high-temperature coolant and low-temperature coolant are mixed homogeneously, and the temperature of the entire volume of the coolant is homogenized. Thus, in the period (corresponding to "predetermined period" of embodiments of the invention) from the end of the flow restricting operation to the time when the temperature of the entire volume of the coolant is homogenized, the temperature of the coolant that flows through the channels inside the engine 1 varies repeatedly or fluctuates.

Figure 3:
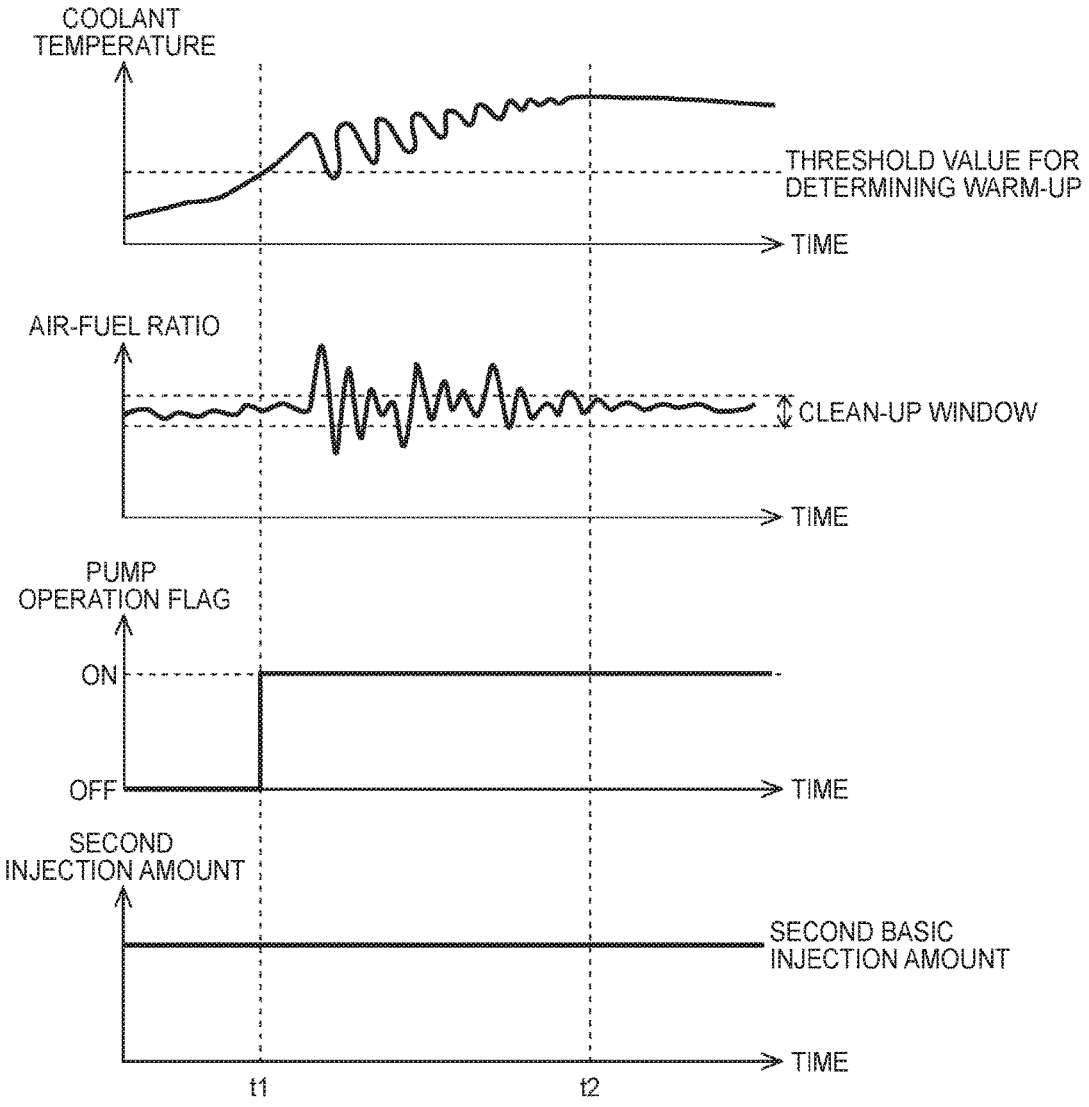
FIG. 3 is a timing chart showing changes in the coolant temperature and the air-fuel ratio with time when a second basic injection amount of fuel is injected from a second fuel injector, after a flow restricting operation is finished.

FIG. 3 shows changes in the temperature of the coolant and the air-fuel ratio of the mixture with time after the end of the flow restricting operation. In FIG. 3, "PUMP OPERATION FLAG" is a flag that is set to off while the water pump 30 is stopped, and is set to on while the water pump 30 is operating. In FIG. 3, "SECOND INJECTION AMOUNT" indicates the amount of fuel actually injected from the second fuel injector 11. In FIG. 3, if the flow restricting operation is finished (at t1 in FIG. 3), the water pump 30 is operated. If the water pump 30 is operated, the low-temperature coolant and the high-temperature coolant alternately flow into the channels inside the engine 1, as described above; therefore, the coolant temperature alternately rises and falls in a repetitive manner. The variation of the coolant is repeated until the high-temperature coolant and the low-temperature coolant are mixed homogeneously (at t2 in FIG. 3), as described above. During a period (from t1 to t2 in FIG. 3) in which the variation of the coolant occurs, the temperature (wall temperature) of a wall of the intake port 7 and the intake valve 9 also fluctuates in accordance with the fluctuations in the coolant temperature. Therefore, during the period in which the variation of the coolant occurs, the amount (wall-deposited fuel amount) of fuel deposited on the wall of the intake port 7 and the intake valve 9 varies. If the wall-deposited fuel amount varies, the amount of fuel flowing from the intake port 7 into the cylinder 2 varies; therefore, the air-fuel ratio of the mixture may deviate from a range (clean-up window) suitable for clean-up of the exhaust gas by the exhaust-gas treatment device 81, or torque fluctuations of the engine 1 may deviate from a range (fluctuation permissible range) in which the driver does not feel strange or uncomfortable about the torque fluctuations. Consequently, exhaust emissions may deteriorate or the driveability may deteriorate, for example, upon ending of the flow restricting operation. To deal with this problem, it may be considered to correct the first basic injection amount and the second basic injection amount based on a measurement value of the water temperature sensor 23. However, under a situation where the coolant temperature rapidly fluctuates, a difference may arise between the measurement value of the water temperature sensor 23 and the wall temperature; therefore, the amount of fuel actually injected from the second fuel injector 11 may not be commensurate with the wall temperature measured at the fuel injection time.

Figure 4:
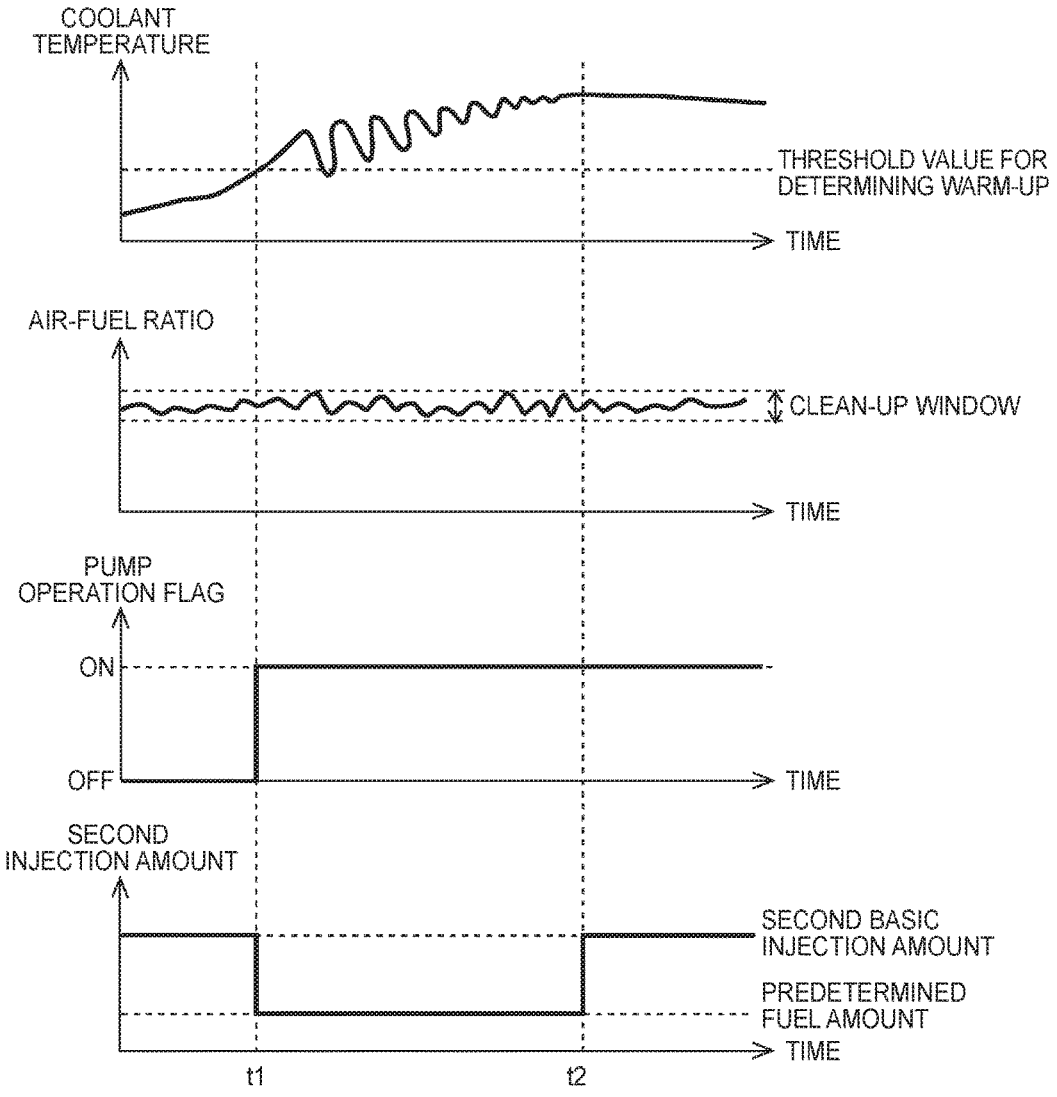
FIG. 4 is a timing chart showing changes in the coolant temperature and the air-fuel ratio with time when the fuel whose amount is equal to or smaller than a predetermined fuel amount is injected from the second fuel injector, after the flow restricting operation is finished.

Thus, in this embodiment, the first fuel injector 5 and the second fuel injector 11 are controlled (injection control under fluctuating water temperature), so that the amount of fuel injected from the second fuel injector 11 is reduced to be smaller than the second basic injection amount determined according to operating conditions of the engine 1, and the amount of fuel injected from the first fuel injector 5 is increased to be larger than the first basic injection amount determined according to the operating conditions of the engine 1, until a predetermined period elapses from ending of the flow restricting operation. More specifically, the ECU 20 restricts the amount of fuel injected from the second fuel injector 11 to a predetermined fuel amount or smaller during the predetermined period. Then, the amount of fuel injected from the first fuel injector 5 is increased so as to compensate for the reduction of the amount of fuel injected from the second fuel injector 11. The "predetermined period" mentioned herein is a period it takes from the time when the flow restricting operation is finished to the time when the temperature of the entire volume of the coolant is homogenized, as described above. The period it takes from the time when the flow restricting operation is finished to the time when the temperature of the entire volume of the coolant is homogenized is correlated with the amount of work of the water pump 30 (the integrated value of drive current); therefore, it may be determined that the predetermined period has elapsed at the point when the amount of work done by the water pump 30 after ending of the flow restricting operation has reached a given amount of work. The given amount of work used in this case is empirically obtained in advance. As another method of determining a lapse of the predetermined period, the maximum time (which will be called "maximum required time") it takes from the time when the flow restricting operation is finished to the time when the temperature of the entire volume of the coolant is homogenized may be empirically obtained in advance, and it may be determined that the predetermined period has elapsed at the point when the elapsed time from ending of the flow restricting operation reaches the maximum required time. The above-mentioned "predetermined fuel amount" is determined so that the air-fuel ratio of the mixture is considered to be held within the clean-up window, even if the fuel whose amount is equal to or smaller than the predetermined fuel amount is injected from the second fuel injector 11 during the predetermined period. The "predetermined fuel amount" is obtained in advance through adaptation work utilizing experiments, or the like. Thus, if the amount of fuel injected from the second fuel injector 11 during the predetermined period is restricted to the predetermined fuel amount or smaller, the air-fuel ratio of the mixture can be held within the clean-up window, even when the coolant temperature fluctuates, as shown in FIG. 4. As a result, exhaust emissions are less likely or unlikely to deteriorate due to ending of the flow restriction operation. The "predetermined fuel amount" may also be determined so that torque fluctuations of the engine 1 are held within a range (fluctuation permissible range) in which the driver does not feel strange or uncomfortable about the torque fluctuations. If the predetermined fuel amount is determined in this manner, the torque fluctuations of the engine 1 can be held within the fluctuation permissible range, even when the coolant temperature fluctuates after ending of the flow restricting operation. As a result, the driveability is less likely or unlikely to deteriorate due to ending of the flow restricting operation. Meanwhile, the "predetermined fuel amount" may be set to the maximum value of the fuel amount with which the air-fuel ratio of the mixture is considered to be held within the clean-up window, or the maximum value of the fuel amount with which the torque fluctuations of the engine 1 are considered to be held within the fluctuation permissible range, even if the fuel whose amount is equal to or smaller than the predetermined fuel amount is injected from the second fuel injector 11 during the predetermined period. In this case, it is possible to make the amounts of fuel injected from the first fuel injector 5 and the second fuel injector 11 as close to the first basic injection amount and the second basic injection amount as possible, while curbing deterioration of exhaust emissions and deterioration of the driveability resulting from ending of the flow restriction operation. The ECU 20, which executes the normal injection control and the injection control under fluctuating water temperature as needed, realizes "control means" according to embodiments of the invention.

Figure 5:
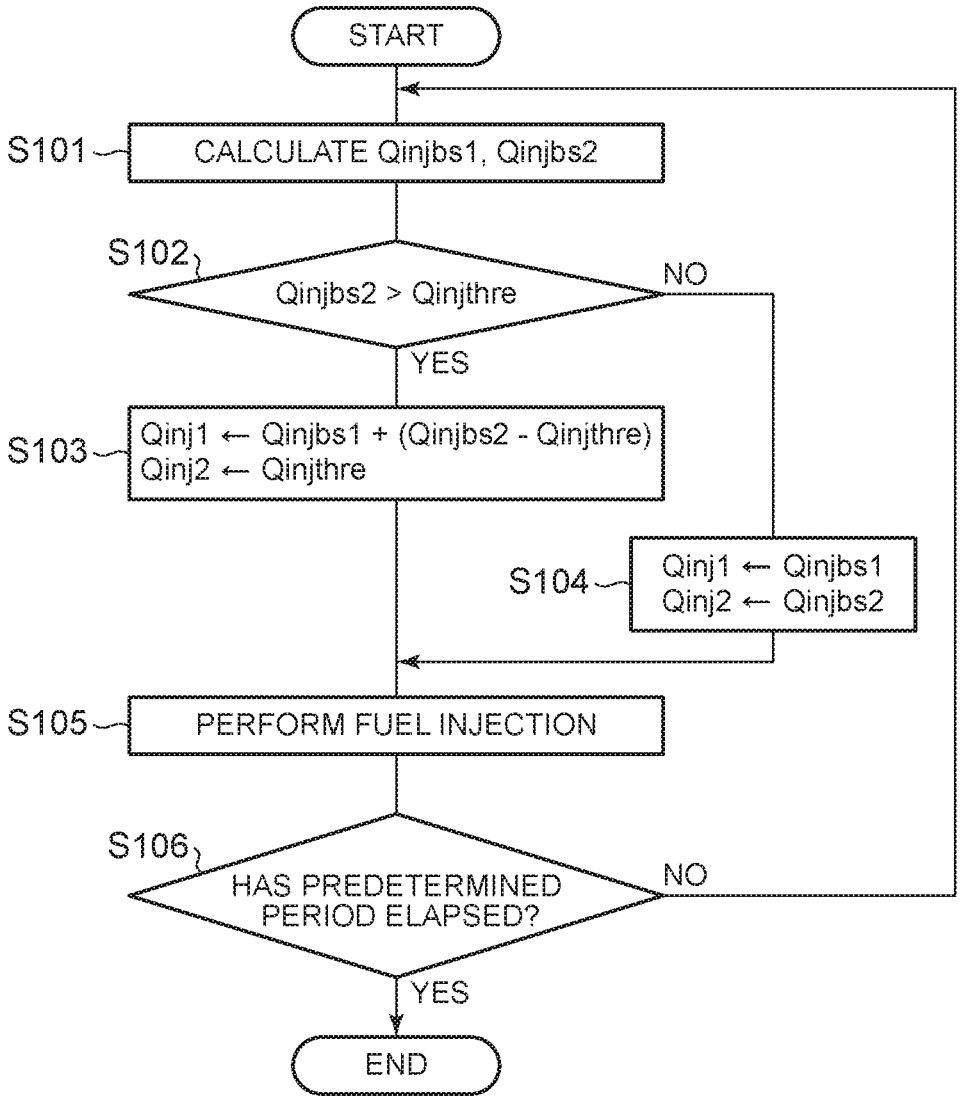
FIG. 5 is a flowchart illustrating a processing routine executed by an ECU when it determines fuel injection amounts.

The procedure of performing the injection control under fluctuating water temperature will be described with reference to FIG. 5. FIG. 5 is a processing routine executed by the ECU 20 upon ending of the flow restricting operation as a trigger, and the processing routine of FIG. 5 is stored in advance in the ROM of the ECU 20.

In the processing routine of FIG. 5, the ECU 20 initially calculates the first basic injection amount Qinjbs1 and the second basic injection amount Qinjbs2, in step S101, using the rotational speed calculated based on the output signal of the crank position sensor 21, the load calculated based on the output signal of the accelerator position sensor 22, the intake air amount measured by the air flow meter 72, and so forth, as parameters. In this connection, a map from which the first basic injection amount Qinjbs1 and the second basic injection amount Qinjbs2 are derived, using the rotational speed, load, and the intake air amount as parameters, may be stored in advance in the ROM of the ECU 20. In another example, a map from which the ratio between the first basic injection amount Qinjbs1 and the second basic injection amount Qinjbs2 is derived, using the rotational speed, load, and the intake air amount as parameters, may be stored in advance in the ROM of the ECU 20, and the first basic injection amount Qinjbs1 and the second basic injection amount Qinjbs2 may be calculated from the total amount of fuel supplied into the cylinder 2 in one cycle and the above-mentioned ratio. In this case, the total amount of fuel supplied into the cylinder 2 in one cycle is supposed to be calculated based on the required torque of the engine 1.

In step S102, the ECU 20 determines whether the second basic injection amount Qinjbs2 calculated in step S101 is larger than a predetermined fuel amount Qinjthre. The predetermined fuel amount Qinjthre is the amount of fuel with which the air-fuel ratio of the mixture is considered to be held within the clean-up window, or the amount of fuel with which the torque fluctuations of the engine 1 are considered to be held within the fluctuation permissible range, even if the fuel whose amount is equal to or smaller than the predetermined fuel amount Qinjthre is injected from the second fuel injector 11 during the predetermined period, as described above. If an affirmative decision (YES) is obtained in step S102 (Qinjbs2>Qinjthre), the ECU 20 proceeds to step S103. If a negative decision (NO) is obtained in step S102 (Qinjbs2≤Qinjthre), the ECU 20 proceeds to step S104.

In step S103, the ECU 20 sets a target fuel injection amount Qinj2 of the second fuel injector 11 to the predetermined fuel amount Qinjthre. Then, the ECU 20 sets a target fuel injection amount Qinj1 of the first fuel injector 5, to the fuel amount (Qinjbs1+(Qinjbs2−Qinjthre)) obtained by adding a difference (Qinjbs2−Qinjthre) between the second basic injection amount Qinjbs2 and the predetermined fuel amount Qinjthre to the first basic injection amount Qinjbs1.

In step S104, on the other hand, the ECU 20 sets the target fuel injection amount Qinj2 of the second fuel injector 11 to the second basic injection amount Qinjbs2, and sets the target fuel injection amount Qinj1 of the first fuel injector 5 to the first basic injection amount Qinjbs1.

After executing step S103 or step S104, the ECU 20 proceeds to step S105. In step S105, the ECU 20 controls the first fuel injector 5 and the second fuel injector 11, according to the target fuel injection amounts Qinj1, Qinj2 set in step S103 or step S104. In this case, since the amount of fuel injected from the second fuel injector 11 is equal to or smaller than the predetermined fuel amount Qinjthre, the air-fuel ratio of the mixture can be held within the clean-up window, or the torque fluctuations of the engine 1 can be held within the fluctuation permissible range, even under the situation where the wall temperature fluctuates after ending of the flow restricting operation.

After executing step S105, the ECU 20 proceeds to step S106. In step S106, the ECU 20 determines whether a predetermined period has elapsed from the time when the flow restricting operation is finished. More specifically, the ECU 20 may determine that the predetermined period has elapsed from the time when the flow restricting operation is finished, if the amount of work done by the water pump 30 from the time when the flow restricting operation is finished is equal to or larger than a given amount of work. Also, the ECU 20 may determine that the predetermined period has elapsed from the time when the flow restricting operation is finished, if the elapsed time from the time when the flow restricting operation is finished is equal to or longer than the above-mentioned maximum required time. If a negative decision (NO) is obtained in step S106, the ECU 20 executes step S101 and subsequent steps again. If, on the other hand, an affirmative decision (YES) is obtained in step S106, the ECU 20 finishes this processing routine. In this case, the normal injection control is performed in the next and subsequent cycles; therefore, the amounts of fuel injected from the first fuel injector 5 and the second fuel injector 11 in one cycle (i.e., the target fuel injection amounts) are set to the first basic injection amount Qinjbs1 and the second basic injection amount Qinjbs2, respectively.

As described above, the ECU 20, which controls the first fuel injector 5 and the second fuel injector 11 according to the processing routine of FIG. 5, realizes "control means" according to embodiments of the invention. As a result, even if the wall temperature fluctuates due to ending of the flow restricting operation, during the predetermined period after ending of the flow restricting operation, the air-fuel ratio of the mixture is less likely or unlikely to deviate from the clean-up window, or the torque fluctuations of the engine 1 are less likely or unlikely to deviate from the fluctuation permissible range. Consequently, deterioration of exhaust emissions or deterioration of the driveability, which is caused by ending of the flow restricting operation, can be curbed.

Figure 6:
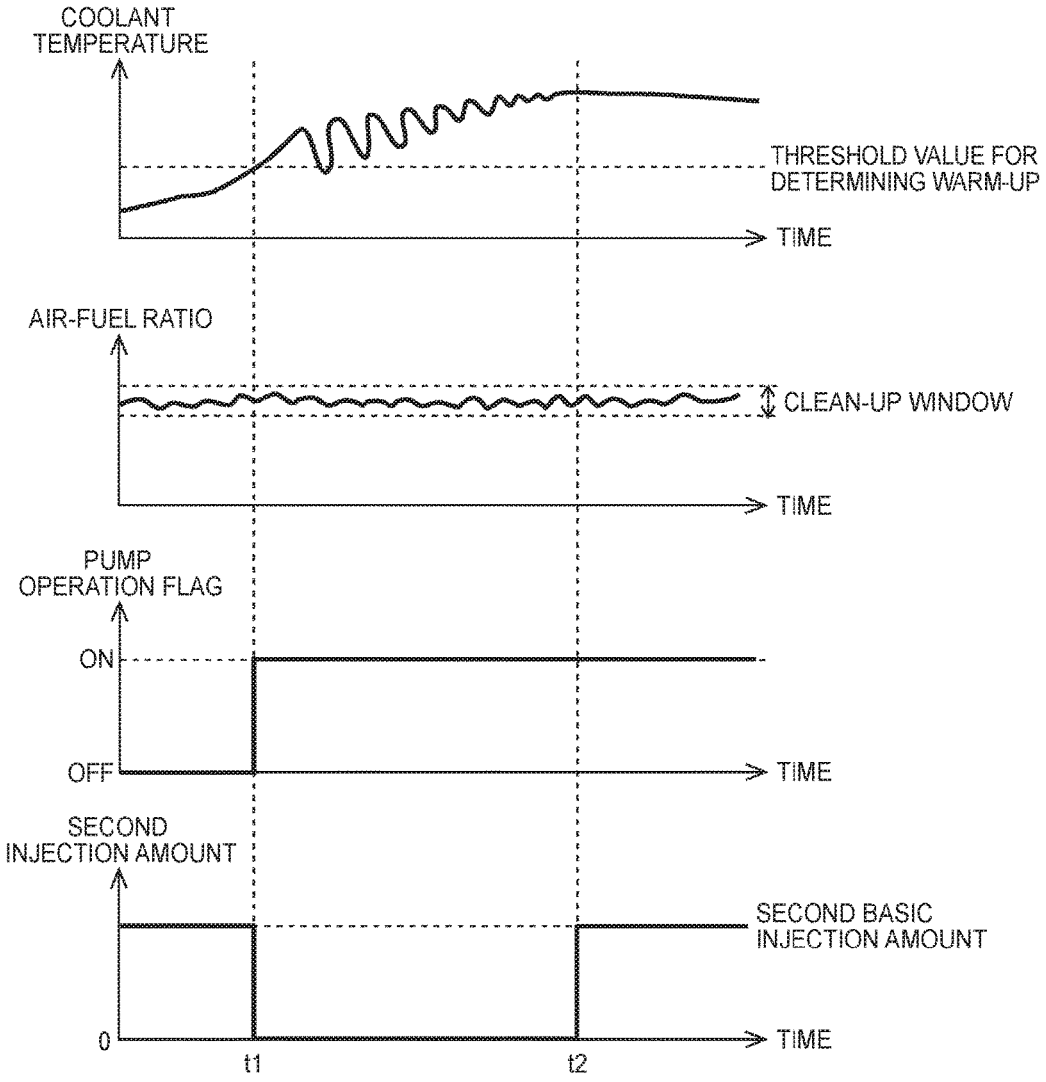
FIG. 6 is a timing chart showing changes in the coolant temperature and the air-fuel ratio with time when the amount of fuel injected from the second fuel injector is set to zero (when the fuel is injected solely from the first fuel injector), after the flow restricting operation is finished.

In this embodiment, the amount of fuel injected from the second fuel injector 11 in one cycle during the predetermined period is set to be equal to or smaller than the predetermined fuel amount Qinjthre. However, as shown in FIG. 6, the amount of fuel injected from the second fuel injector 11 during the predetermined period may be set to zero, and the fuel may be injected solely from the first fuel injector 5. In this case, the wall-deposited fuel amount does not fluctuate due to ending of the flow restricting operation, and therefore, fluctuations in the air-fuel ratio can be reduced with higher reliability.

In this embodiment, the flow restricting operation is performed by stopping operation of the water pump 30. However, the flow restriction operation may also be performed by other methods, i.e., by reducing the amount of work of the water pump 30 per unit time, or intermittently operating the water pump 30, namely, by restricting the flow rate of the coolant circulating in the engine 1 per unit time to a predetermined amount (e.g., an amount small enough not to prevent warm-up of the engine). Even in the case where the flow restricting operation is performed by any of these methods, the temperature distribution of the coolant as described above in FIG. 3 is formed; therefore, the period it takes for the temperature distribution to be eliminated (until the temperature of the entire volume of the coolant is homogenized) may be determined as the predetermined period, and the fuel injection amount of the second fuel injector 11 during the predetermined period may be restricted to the predetermined fuel amount or smaller.

In the above-described embodiment, the invention is applied to the internal combustion engine in which the flow restricting operation is performed by restricting operation of the electrically-operated water pump 30. However, embodiments of the invention may also be applied to an internal combustion engine in which the flow restricting operation is performed by causing the coolant to circulate while bypassing the engine 1.

Figure 7:
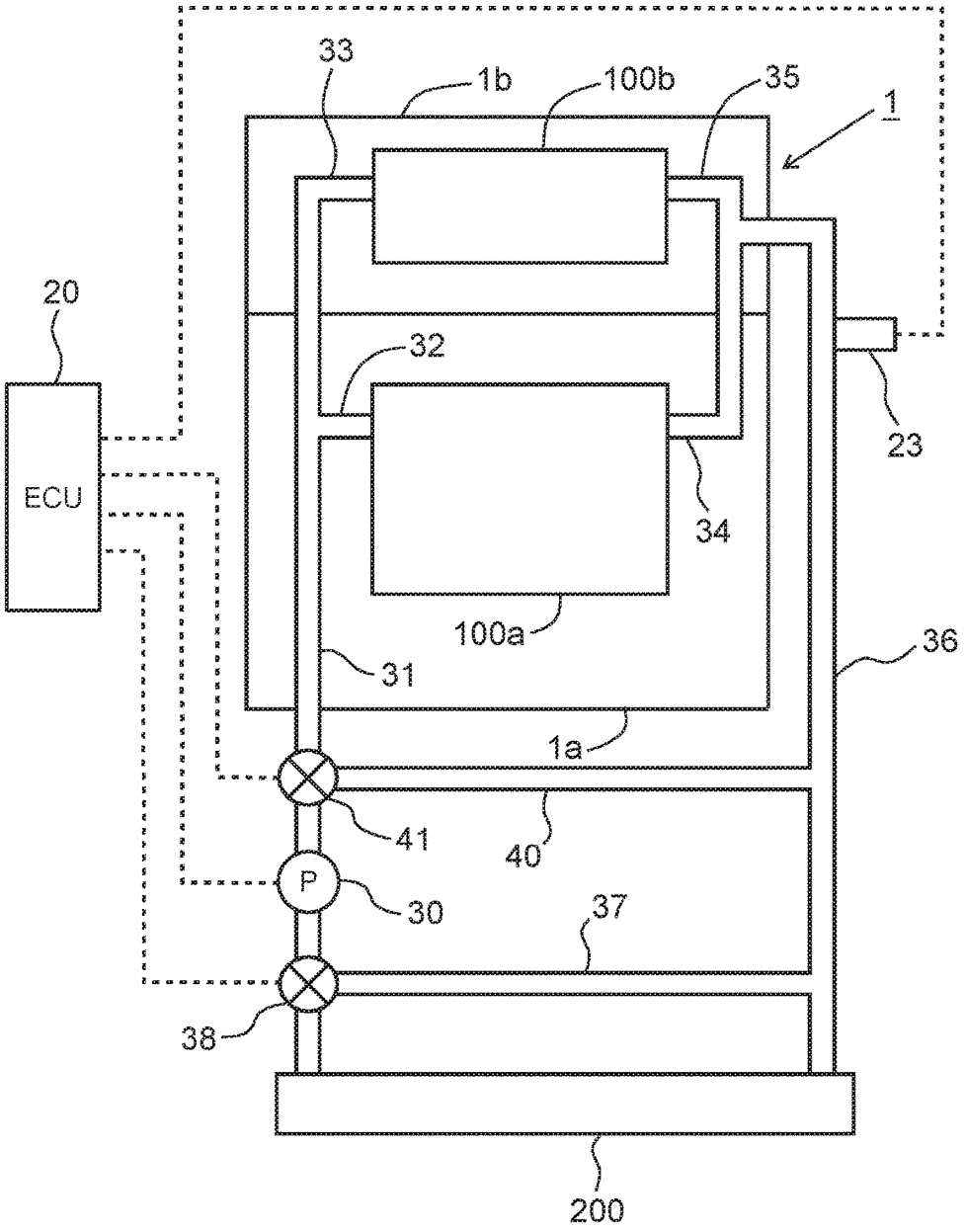
FIG. 7 is a view showing another example of cooling system of an internal combustion engine to which the invention is applied.

FIG. 7 shows another example of a cooling system of the internal combustion engine 1. In FIG. 7, the same reference numerals are assigned to the same or corresponding constituent elements as those of FIG. 2 as described above. In FIG. 7, the delivery channel 31 and the return channel 36 are connected by a bypass channel 40 for bypassing the block-side coolant channel 100*a* and head-side coolant channel 100*b* of the engine 1. A thermostat 41 that switches between a position for conducting the delivery channel 31 and a position for shutting off the delivery channel 31 is provided at a connecting portion where the bypass channel 40 and the delivery channel 31 are connected to each other. When the temperature of the coolant is equal to or lower than the above-described threshold value for determining warm-up of the engine 1, the thermostat 41 shuts off the delivery channel 31, so as to establish flow of the coolant bypassing the block-side coolant channel 100*a* and head-side coolant channel 100*b* of the engine 1. When the temperature of the coolant becomes higher than the above-described threshold value for determining warm-up, the thermostat 41 permits the coolant to pass through the delivery channel 31, so as to establish flow of the coolant through the block-side coolant channel 100*a* and head-side coolant channel 100*b* of the engine 1. When the temperature of the coolant is higher than the threshold value for determining warm-up, the thermostat 41 may be arranged to shut off the bypass channel 40. Also, the thermostat 41 may be a mechanical thermostat that automatically opens and closes according to the temperature of the coolant, or may be an electrically-operated thermostat that is opened and closed under control of the ECU 20.

According to the cooling system constructed as described above, the thermostat 41 shuts off the delivery channel 31, so as to stop circulation of the coolant through the block-side coolant channel 100*a* and the head-side coolant channel 100*b*. Therefore, the flow restricting operation can be carried out even if the water pump 30 is a mechanical pump that is driven using power of the engine 1. If the first fuel injector 5 and the second fuel injector 11 are controlled in substantially the same manner as that of the above-described embodiment, during the predetermined period after ending of the flow restricting operation, the air-fuel ratio of the mixture is less likely or unlikely to deviate from the clean-up window, or the torque fluctuations of the engine 1 are less likely or unlikely to deviate from the fluctuation permissible range, even if the wall temperature fluctuates due to ending of the flow restricting operation.

What is claimed is:

1. A control system for an internal combustion engine, the control system comprising:

a first fuel injector that injects fuel into a cylinder of the internal combustion engine;

a second fuel injector that injects fuel into an intake passage of the internal combustion engine; and an electronic control unit (ECU) including a processor and a memory, wherein the electronic control unit is configured to:

(a) control a water pump and perform a flow restricting operation, wherein when the internal combustion engine is in a cold state, flow rate of a coolant circulating in the internal combustion engine is restricted to a predetermined flow rate or less, or circulation of the coolant in the internal combustion engine is stopped, (b) during the flow restricting operation, perform normal injection control to control the first fuel injector and the second fuel injector, such that an amount of the fuel injected from the first fuel injector per cycle is equal to a first basic injection amount corresponding to an operating conditions of the internal combustion engine, and an amount of the fuel injected from the second fuel injector per cycle is equal to a second basic injection amount corresponding to the operating conditions of the internal combustion engine, (c) perform injection control to reduce fluctuation of air-fuel ratio under fluctuating water temperature to control the first fuel injector and the second fuel injector, such that the amount of the fuel injected from the first fuel injector per cycle is larger than the first basic injection amount corresponding to the operating condition of the internal combustion engine, and the amount of the fuel injected from the second fuel injector per cycle is smaller than the second basic injection amount, during a predetermined period (from time t1 to time t2) after the flow restricting operation ends, and (d) after the predetermined period, perform the normal injection control to control the first fuel injector and the second fuel injector, such that the amount of the fuel injected from the first fuel injector per cycle is equal to the first basic injection amount and the amount of the fuel injected from the second fuel injector per cycle is equal to the second basic injection amount.

2. The control system according to claim 1, wherein the electronic control unit is configured to control the first fuel injector and the second fuel injector, such that the amount of the fuel injected from the second fuel injector in one cycle is equal to or smaller than a predetermined fuel amount, during the predetermined period after the fuel restricting operation is finished.

3. The control system according to claim 1, wherein the predetermined period is a period from a time when the flow restricting operation ends to a time when a temperature of the entire volume of the coolant is homogenized.

4. The control system according to claim 1, wherein the predetermined period is a period from a time when the flow restricting operation is finished to a time when an amount of work of the water pump reaches a predetermined amount of work.

5. A control system for an internal combustion engine, the control system comprising:

a first fuel injector that injects fuel into a cylinder of the internal combustion engine;

a second fuel injector that injects fuel into an intake passage of the internal combustion engine; and an electronic control unit (ECU) including a processor and a memory, wherein the electronic control unit is configured to:

(a) control a water pump and perform a flow restricting operation, wherein when the internal combustion engine is in a cold state, flow rate of a coolant circulating in the internal combustion engine is restricted to a predetermined flow rate or less, or circulation of the coolant in the internal combustion engine is stopped, (b) during the flow restricting operation, perform normal injection control to control the first fuel injector and the second fuel injector, such that an amount of the fuel injected from the first fuel injector per cycle is equal to a first basic injection amount corresponding to an operating condition of the internal combustion engine, and an amount of the fuel injected from the second fuel injector per cycle is equal to a second basic injection amount corresponding to the operating condition of the internal combustion engine, (c) perform injection control to reduce fluctuation of air-fuel ratio under fluctuating water temperature to control the first fuel injector and the second fuel injector, such that the amount of the fuel injected from the first fuel injector per cycle is larger than the first basic injection amount corresponding to the operating condition of the internal combustion engine, and the amount of the fuel injected from the second fuel injector per cycle is smaller than the second basic injection amount corresponding to the operating condition of the internal combustion engine, during a predetermined period from a first time when the flow restricting operation is finished to a second time when high-temperature coolant and low-temperature coolant are mixed homogeneously, and (d) after the predetermined period, perform the normal injection control to control the first fuel injector and the second fuel injector, such that the amount of the fuel injected from the first fuel injector per cycle is equal to the first basic injection amount and the amount of the fuel injected from the second fuel injector per cycle is equal to the second basic injection amount.

6. The control system according to claim 5, wherein the electronic control unit is configured to control the first fuel injector and the second fuel injector, such that the amount of the fuel injected from the second fuel injector in one cycle is equal to or smaller than a predetermined fuel amount, during the predetermined period after the fuel restricting operation is finished.

7. The control system according to claim 5, wherein an amount of work of the water pump reaches a predetermined amount of work during the predetermined period.

* * * * *